US008056254B2

(12) United States Patent
Löffler et al.

(10) Patent No.: US 8,056,254 B2
(45) Date of Patent: Nov. 15, 2011

(54) TUMBLE DRYER WITH A LINT FILTER

(75) Inventors: Holger Löffler, Berlin (DE); Henry Ott, Berlin (DE); Philipp Steusloff, Berlin (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 358 days.

(21) Appl. No.: 11/989,457

(22) PCT Filed: Jun. 27, 2006

(86) PCT No.: PCT/EP2006/063608
§ 371 (c)(1),
(2), (4) Date: Jan. 25, 2008

(87) PCT Pub. No.: WO2007/012536
PCT Pub. Date: Feb. 1, 2007

(65) Prior Publication Data

US 2009/0260247 A1 Oct. 22, 2009

(30) Foreign Application Priority Data

Jul. 29, 2005 (DE) ..... 10 2005 035 652

(51) Int. Cl.
*F26B 21/06* (2006.01)
*F26B 11/02* (2006.01)

(52) U.S. Cl. ..... 34/82; 34/134

(58) Field of Classification Search ..... 34/72, 82, 34/130, 134
See application file for complete search history.

(56) References Cited

U.S. PATENT DOCUMENTS

| | | | | |
|---|---|---|---|---|
| 3,190,011 | A * | 6/1965 | Shields | 34/77 |
| 6,739,359 | B2 * | 5/2004 | Jones et al. | 141/64 |
| 2003/0014880 | A1 * | 1/2003 | Baurmann | 34/595 |
| 2005/0086832 | A1 * | 4/2005 | Declos | 34/604 |

FOREIGN PATENT DOCUMENTS

| | | | |
|---|---|---|---|
| DE | 4304372 | A1 | 8/1994 |
| DE | 100 02 742 | | 6/2001 |
| DE | 100 58 141 | | 5/2002 |
| DE | 101 48 700 | | 5/2002 |
| EP | 0 477 554 | | 4/1992 |
| EP | 1548178 | A2 | 12/2004 |
| GB | 2142128 | A | 1/1985 |
| GB | 2269445 | A | 2/1994 |
| GB | 2 300 700 | | 11/1996 |
| WO | WO 2005/090669 | | 9/2005 |

OTHER PUBLICATIONS

International Search Report PCT/EP2006/063608. Miele Novotronic, "Gebrauchsanweisung Kondenstrockner T 494 C" with translation of relevant portions—pp. 23-24.
Lavatherm 59800, Kondensationstrockner mit Warmepumpe, Benutzerinformation, AEG Hausgerate GmbH with translation of relevant portions—pp. 18-20.
Oko-Lavatherm WP, Kondensationstrockner mit Warmepumpe, Gebrauchsanweisung, AEG Hausgerate GmbH with translation of relevant portions—pp. 26-27.

* cited by examiner

*Primary Examiner* — Jiping Lu
(74) *Attorney, Agent, or Firm* — James E. Howard; Andre Pallapies

(57) ABSTRACT

A tumble dryer is provided having a heat exchanger through which a process-air stream flows in a first direction and a first duct which is arranged in fluid communication with the heat exchanger through which a process-air stream flows in a second direction and in which a lint filter is disposed. A tray having its own lint filter is removably attached to the heat exchanger and arranged between the duct and the heat exchanger.

23 Claims, 3 Drawing Sheets

TUMBLE DRYER WITH A LINT FILTER

The invention relates to a tumble dryer comprising a heat exchanger through which a process air stream is able to flow in a horizontal direction and a duct which is arranged upstream of the heat exchanger and through which a process air stream flows in a vertically falling direction, in which a lint filter is arranged.

BACKGROUND OF THE INVENTION

Such a tumble dryer emerges from EP 0 477 554 B1, the contents of which is to be fully included in the present document. In this tumble dryer the heat exchanger through which the process air flows, despite the lint filter by which a large part of the lint arising during the drying process is trapped, is increasingly subjected to the effects of lint which the stream of process air carries with it out of a drum with washing to be dried and which, because of its small size, is not trapped in the lint filter. Such lint is deposited with condensing water vapor in the vicinity of the heat exchanger. In such cases the lint remains mainly in the inflow area of the heat exchanger and gradually forms a felt which perceptibly impedes the stream of process air and worsens the heat transfer within the heat exchanger. This can have significant adverse effects on the efficiency of the tumble dryer. A removable grating is provided on an inlet stream side of the heat exchanger, on which the lint is intended to be deposited and which can be taken out relatively easily to remove the lint. After the grating is taken out the lint can be removed by rinsing the grating through with water.

Whereas this provides a thoroughly practical aid for the removal of lint which is deposited directly on the heat exchanger, the problem remains of lint also accumulating in other locations in the duct for the process air between the drum and the heat exchanger. It is especially likely that condensation of moisture, which starts as soon as the process air stream has left the drum, will promote the deposition of lint. Such lint is especially deposited in the deepest part of the duct where the process air must be diverted from a vertically falling direction to a horizontal direction pointing towards the heat exchanger.

SUMMARY OF THE INVENTION

Accordingly the object of the present invention is to create a tumble dryer in which if possible all of the lint deposited between the drum and the heat exchanger is trapped and can be disposed of if required.

To achieve this object a tumble dryer is specified comprising a heat exchanger through which a process air stream can flow in a horizontal direction and a duct arranged upstream of the heat exchanger through which a process air stream flows in a vertically falling direction, in which a lint filter is arranged, in which tumble dryer a tray is arranged between the duct and the heat exchanger which is removably mounted on the heat exchanger and is open in the horizontal direction and counter to the vertically falling direction is arranged between the duct and the heat exchanger which is embodied as a diverter for the process air stream.

The invention thus creates a tumble dryer in which that unit which is to be arranged at the lowest position of the outlet duct of the heat exchange for the process air between a drum of the tumble dryer and the heat exchanger is configured to trap all the lint arising there and is removable for disposal of such lint from the heat exchanger device. This makes possible regular cleaning of the locations most heavily affected by lint buildup in a tumble dryer, and to dispose of the lint it is not even necessary to touch it with a finger or with a hand.

A major feature of a preferred embodiment is that the tray features a grating with which it is mounted on the heat exchanger. As regards the embodiment of such a grating the reader is referred to the fully referenced document EP 0 477 554 B1.

It is likewise preferred for the tray to be provided with a grip to guarantee ease of handling. Preferably the heat exchanger and the duct can be jointly attached, with this being done especially advantageously by means of a securing device which lies outside the tray.

BRIEF DESCRIPTION OF THE DRAWINGS

Exemplary embodiments of the invention are explained below with reference to the drawing.

The individual figures show.

DETAILED DESCRIPTION OF THE EXEMPLARY EMBODIMENTS OF THE PRESENT INVENTION

Figure 1:
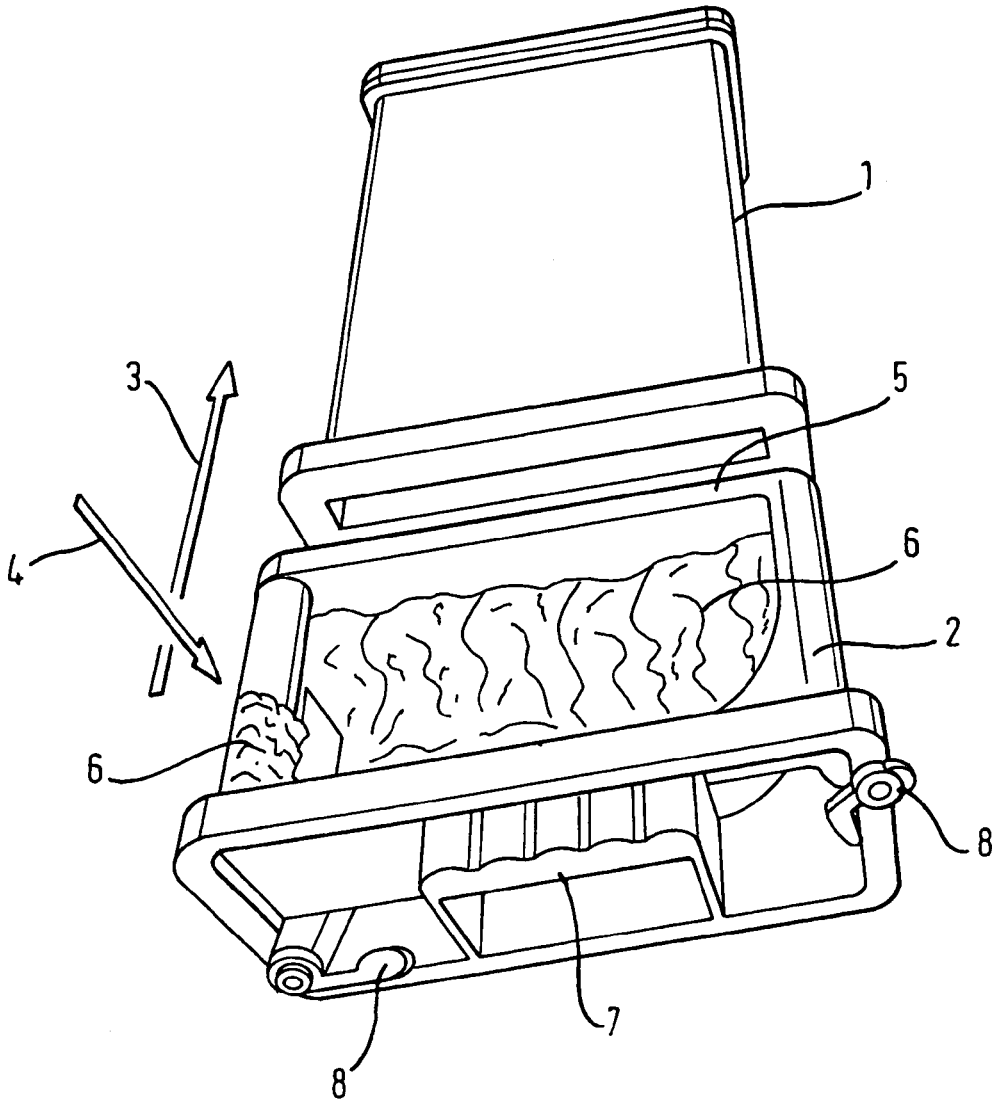
FIG. 1: a heat exchanger device for a tumble dryer.

FIG. 1 shows a heat exchanger device for a tumble dryer, comprising a heat exchanger 1, which is embodied as conventional crossflow plate heat exchanger and through which the stream of process air of a tumble dryer must flow in a horizontal direction 3. Mounted in front of the heat exchanger 1 is a tray 2, which serves as a deflector for the process air stream which flows in in a vertically falling direction 4, coming from the drying chamber of the tumble dryer (cf. FIG. 4) and is diverted into the horizontal direction 3. This tray 2 is mounted with a grating 5 on the heat exchanger 1 and serves to catch lint 6, which is shown here as a more or less loose and detached mass and which despite previous filtering (cf. FIG. 4) is carried along by the process air stream. The tray 2 forms the lowest point of the duct through which the process air stream moves from the drum to the heat exchanger 1, and can thus collect almost all lint 6 carried along in the air stream. The grating 5 covered in FIG. 1 by the lint 6, which accepts the lint 6 deposited in the vicinity of the heat exchanger 6 is also of importance, allowing the latter to be removed by rinsing out the tray 2 under water. For ease of handling the tray 2 is provided with a grip 7. Also shown is a securing device 8 comprising two levers and clips (not visible), with which the heat exchanger device can be attached in a tumble dryer to allow easy removal.

Figure 2:
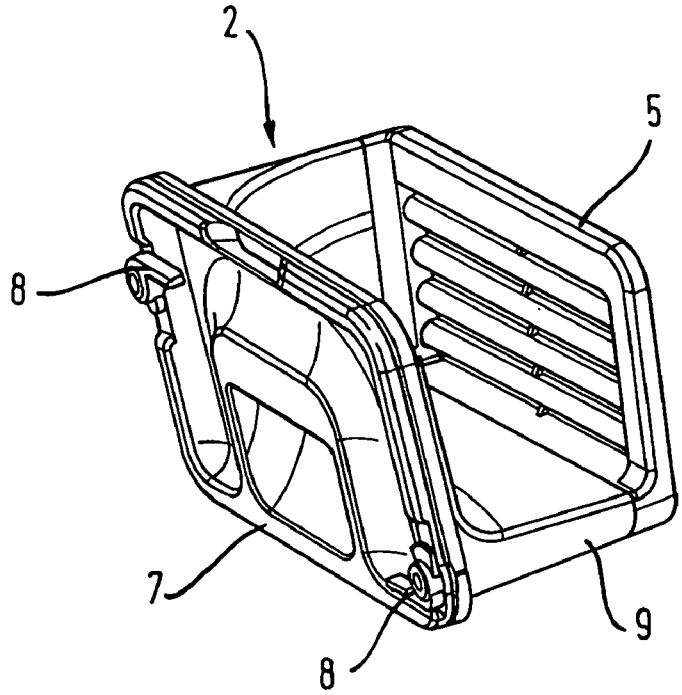
FIGS. 2 and 3: a tray for such a heat exchanger device.
Figure 3:
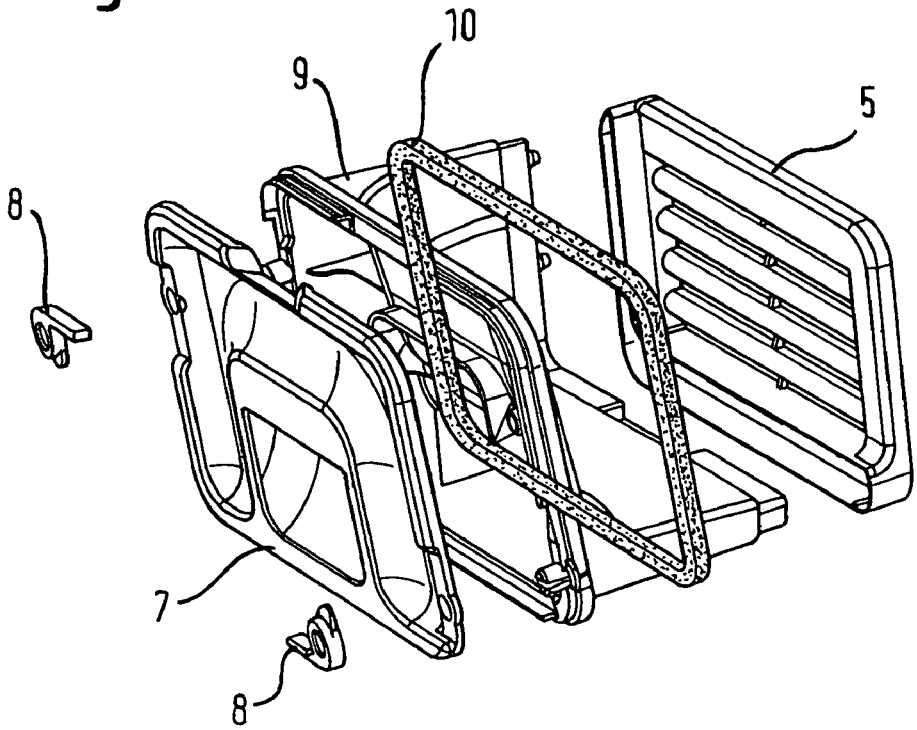

FIGS. 2 and 3 show the structure of the tray 2. The tray 2 consists of the grating 5 to be mounted on the heat exchanger 1 (cf. FIG. 1) which is adjoined by a body section 9. The grip is mounted on the body section 9 on a side facing away from the grating 5, to which the levers of the securing device 8 are or will also be attached. Inserted between the grip 7 and the body 9 is a seal 10, with which the duct for the process air stream in the area of the heat exchanger device can be sealed from its surroundings.

Figure 4:
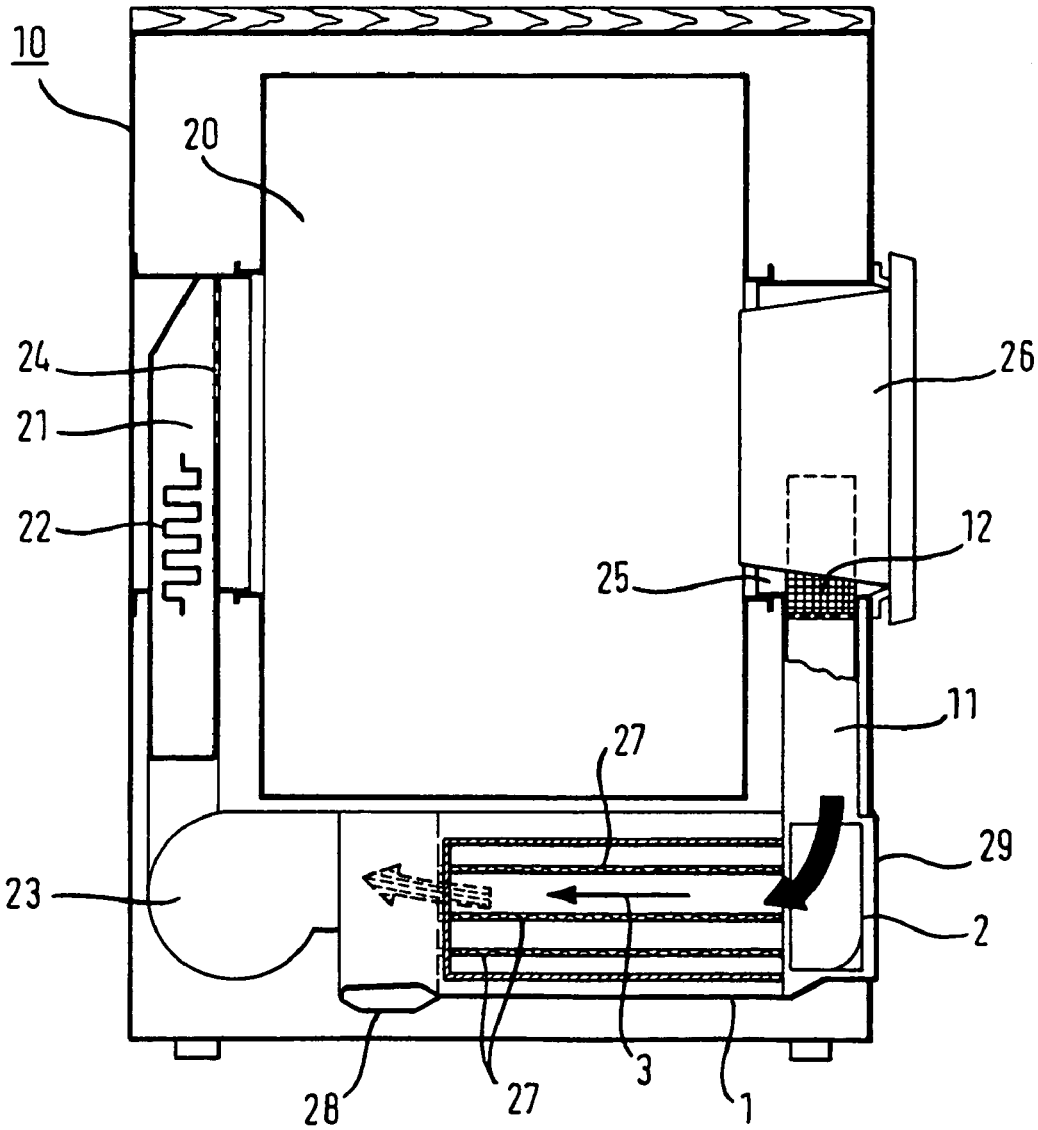
FIG. 4: a tumble dryer.

FIG. 4 shows a sectional view of a tumble dryer 10 comprising a heat exchanger 1 and a tray 2, as in the previous figures. The tumble dryer 10 comprises an internal drying space 20, which is especially embodied as a drum supported to allow horizontal rotation. Between the drying space 20 and a rear of the dryer 10 is located an inlet air duct 21, in which the process air stream is heated up by means of a heating device 22 and is blown by a fan 23 through a perforated rear wall 24 into the drying space 20. On the front of the dryer 10 is located a loading opening 25 for loading the washing to be dried into the drying space 20. A door 26 is used to seal off the drying space 20.

The process air stream blown by the fan 23 into the drying space 20 and from there into an annular gap between the door 26 and an edge section of the loading opening 25 arrives through a lint filter 12 in the outlet air duct 11 from where it travels through the tray 2 into the heat exchanger 1 and back to the fan 23. The heat exchanger 1 is shown in section along the flow direction 3 and contains plates 27 with good heat conductivity with hollow spaces through which a cooling medium, especially fresh cooling air, flows in a transverse direction to the process air stream. The process air stream is shown on a cold side of the heat exchanger 1 by a large arrow with lengthwise dashed lines, on a warm side of the heat exchanger 1 by a solid arrow. The process air stream releases heat and moisture to the plates 27 and reaches the fan 23 as cooled air. The moisture collects at the warm end of the heat exchanger 1 and flows to a condensate collection vessel 28, from where it is pumped away or can be disposed of in some other way. The tray 2 and the heat exchanger 1 are accessible via a flap 29 so that they can be taken out and cleaned by an operator.

The invention creates a simple and easy-to-manage option for largely complete trapping of lint which is carried around in a tumble dryer by the process air stream, and thereby supports a functionally secure and also energy-saving operation of a correspondingly equipped tumble dryer.

The invention claimed is:

1. A tumble dryer, comprising:

a heat exchanger defining a passageway through which a process air stream can flow in a first direction;

a first duct in fluid communication with the heat exchanger and upstream of the heat exchanger and defining a passageway through which the process air can flow in a second direction;

a lint filter in the first duct and through which the process air stream passes in the first direction; and a removable tray in fluid communication with both the heat exchanger and the first duct and disposed therebetween, the removable tray configured to divert the process air stream between the first direction and the second direction.

2. The tumble dryer according to claim 1, wherein the tray includes a grating with which the tray is mounted on the heat exchanger.

3. The tumble dryer according to claim 1 wherein the tray includes a gripping surface.

4. The tumble dryer according to claim 1 wherein the tray is removable in a horizontal direction.

5. The tumble dryer according to claim 1 wherein the heat exchanger is configured for attachment with the tray.

6. The tumble dryer according to claim 5, wherein the heat exchanger and the tray can be attached with a securing device with the securing device lying outside an area of the tray which influences the process-air stream.

7. The tumble dryer according to claim 1 wherein the tray is covered by a flap.

8. The tumble dryer of claim 7, wherein the removable tray is removable through the flap.

9. The tumble dryer of claim 1, wherein the tray is located at a lowest point in the process air stream from the first duct to the heat exchanger.

10. The tumble dryer of claim 1, wherein the tray comprises:

a body section that diverts the process air stream flowing in the second direction from the first duct to the first direction and into the heat exchanger, and a grating through which the process air stream flows in the first direction, the grating coupling the body section to the heat exchanger.

11. The laundry dryer of claim 10, wherein the tray comprises:

a grip coupled to the body section on a side facing away from the grating.

12. The laundry dryer of claim 11, wherein the tray comprises:

a seal between the grip and the body section.

13. A laundry dryer comprising:

a housing;

a drying space within in the housing;

a first duct that is in fluid communication with the drying space and through which a process air stream from the drying space flows in a vertically falling direction;

a lint filter arranged on the first duct and through which the process air stream flows in the vertically falling direction;

a heat exchanger arranged downstream of the first duct and through which the process air stream flows in a horizontal direction; and a removable tray arranged between the first duct and the heat exchanger and in fluid communication with the first duct and the heat exchanger, wherein the removable tray diverts the process air stream flowing in the vertically falling direction from the first duct to the horizontal direction and into the heat exchanger.

14. The laundry dryer of claim 13, wherein the tray is located at a lowest point in the process air stream from the drying space to the heat exchanger.

15. The laundry dryer of claim 13, wherein the tray includes a grating.

16. The laundry dryer of claim 15, wherein the grating of the tray is coupled to the heat exchanger.

17. The laundry dryer of claim 13, wherein the tray comprises:

a body section that diverts the process air stream flowing in the vertically falling direction from the first duct to the horizontal direction and into the heat exchanger, and a grating through which the process air stream flows in the horizontal direction, the grating coupling the body section to the heat exchanger.

18. The laundry dryer of claim 17, wherein the tray comprises:

a grip coupled to the body section on a side facing away from the grating.

19. The laundry dryer of claim 18, wherein the tray comprises:

a seal between the grip and the body section.

20. The laundry dryer of claim 13, wherein the removable tray is coupled removably to the heat exchanger such that the tray is removable from the heat exchanger in the horizontal direction.

21. The laundry dryer of claim 13, comprising:

a securing device that secures the tray to the heat exchanger, wherein the securing device is disposed outside of the process air stream.

22. The laundry dryer of claim 13, wherein the housing comprises:

a flap through which the removable tray is removable from the housing.

23. The laundry dryer of claim 13, wherein the housing comprises:

a flap through which the removable tray and the heat exchanger are removable from the housing.

* * * * *